US011846220B2

(12) United States Patent
Nishimura

(10) Patent No.: US 11,846,220 B2
(45) Date of Patent: Dec. 19, 2023

(54) ENGINE

(71) Applicant: Yanmar Power Technology Co., Ltd., Osaka (JP)

(72) Inventor: Shinji Nishimura, Osaka (JP)

(73) Assignee: Yanmar Power Technology Inc., Ltd., Osaka (JP)

( * ) Notice: Subject to any disclaimer, the term of this patent is extended or adjusted under 35 U.S.C. 154(b) by 0 days.

(21) Appl. No.: 17/529,174

(22) Filed: Nov. 17, 2021

(65) Prior Publication Data

US 2022/0074330 A1 Mar. 10, 2022

Related U.S. Application Data

(63) Continuation of application No. 17/076,824, filed on Oct. 22, 2020, now Pat. No. 11,203,959, which is a (Continued)

(30) Foreign Application Priority Data

Jun. 15, 2017 (JP) ..... 2017-117372

(51) Int. Cl.
*F02F 1/24* (2006.01)
*F01N 3/035* (2006.01)
(Continued)

(52) U.S. Cl.
CPC ..... *F01N 3/035* (2013.01); *F02F 1/24* (2013.01); *F02M 35/104* (2013.01); *F02M 35/10222* (2013.01)

(58) Field of Classification Search
CPC .. F01N 3/035; F01N 13/1805; F01N 13/1855; F01N 13/1861; F01N 2590/08; F02F 1/24; F02M 35/10222; F02M 35/104
See application file for complete search history.

(56) References Cited

U.S. PATENT DOCUMENTS

2017/0218808 A1* 8/2017 Kurokawa ..... F02M 26/22

FOREIGN PATENT DOCUMENTS

WO WO-2011002055 A1 * 1/2011 ..... B66F 9/07595
WO WO-2012035995 A1 * 3/2012 ..... B60K 13/04
(Continued)

OTHER PUBLICATIONS

English translation of Noma WO 2011002055 (Year: 2011).*

*Primary Examiner* — Joseph J Dallo
(74) *Attorney, Agent, or Firm* — Chris Mizumoto

(57) ABSTRACT

An engine that suppresses damage on a support mechanism of a diesel particulate filter (DPF) due to vibration in the pitch direction, in which the DPF, which purifies exhaust gas from an exhaust manifold, is disposed in an orientation orthogonal or approximately orthogonal to a rotational axis of a crankshaft in a plan view. A support mechanism is provided, which enables a cylinder head, an intake manifold, and an intake collector to support the DPF. The support mechanism includes a first support position in which the cylinder head supports the DPF, a second support position in which the intake manifold supports the DPF, and a third support position in which the intake collector supports the DPF. The third support position deviates from the first support position and the second support position in a direction of the rotational axis of the crankshaft.

4 Claims, 8 Drawing Sheets

Related U.S. Application Data continuation of application No. 16/622,218, filed as application No. PCT/JP2018/018150 on May 10, 2018, now Pat. No. 10,858,975.

(51) Int. Cl.
*F02M 35/10* (2006.01)
*F02M 35/104* (2006.01)

(56) References Cited

FOREIGN PATENT DOCUMENTS

| | | | | |
|---|---|---|---|---|
| WO | WO-2016059963 A1 * | 4/2016 | ..... | B60K 13/04 |
| WO | WO-2016060026 A1 * | 4/2016 | ..... | B60K 11/02 |

* cited by examiner

ENGINE

CROSS-REFERENCE

This is a continuation of U.S. Application Ser. No. 17/076,824 filed Oct. 22, 2020, which is a continuation of U.S. application Ser. No. 16/622,218 filed Dec. 12, 2019, which is a US National Stage Application under 35 U.S.C. § 371 of International Application No. PCT/JP2017/018150 filed May 10, 2018, which claims foreign priority of JP2017-117372 filed Jun. 15, 2017, the disclosures of which are hereby incorporated by reference in their entirety.

TECHNICAL FIELD

The present invention relates to engines, such as diesel engines mounted on work machines like construction machines or agricultural machines for example. Specifically, the present invention relates to an engine in which a diesel particulate filter (DPF) for purifying exhaust gas from an exhaust manifold is disposed above a cylinder head in an orientation orthogonal or approximately orthogonal to the rotational axis of a crankshaft in a plan view and an intake collector for returning part of the exhaust gas to an intake manifold as exhaust gas recirculation (EGR) gas is fixed to the intake manifold.

BACKGROUND ART

In the above-described engine, the DPF disposed above the cylinder head is in a lateral orientation orthogonal or approximately orthogonal to the rotational axis of the crankshaft in a plan view. Thus, space occupied around the engine can be decreased more than that, for example, in a case where the DPF is disposed along the direction of the rotational axis of the crankshaft.

To enable the DPF in the above-described lateral orientation to be supported on the engine, as described in Patent Literature 1 (hereinafter referred to as PTL1), a support mechanism for enabling the cylinder head and the intake manifold to support the DPF is typically provided. Such a support mechanism is made up of an inlet-side bracket for fixing a portion of the DPF positioned toward the exhaust manifold to a left side surface of the cylinder head, an outlet-side bracket for fixing a portion of the DPF positioned toward the intake manifold to a front surface of the cylinder head, and a coupling bracket for coupling an intermediate portion of the outlet-side bracket positioned between the top and bottom thereof to the intake manifold.

CITATION LIST

Patent Literature

PTL1: Japanese Patent Application Laid-Open No. 2015-178813

SUMMARY OF INVENTION

Technical Problem

In the above-described DPF supporting structure, the position in which the inlet-side bracket is attached to the left side surface of the cylinder head, the position in which the outlet-side bracket is attached to the front surface of the cylinder head, and the position in which the coupling bracket is attached to the intake manifold are close to each other with respect to a line segment in a direction orthogonal to the rotational axis of the crankshaft in a plan view. Thus, the vibration that has propagated to the engine can easily cause the DPF to vibrate in the pitch direction along the rotational axis direction of the crankshaft (the direction of arrows b in FIG. 1).

Particularly in an engine mounted on a work machine, such as a skid steer loader or the like, an apparatus to be driven (hereinafter referred to as a driven apparatus), which is large in mass (see the portions indicated with the imaginary lines in FIGS. 1 and 2), such as a hydraulic pump or the like for the work machine, is fixed and coupled to a flywheel housing that an output shaft portion for the driven apparatus faces. Accordingly, when the work machine travels over an uneven surface of the ground or steps for example, up-down vibration of the work machine (in the direction of arrows a in FIG. 1) is amplified by the driven apparatus large in mass and propagates to the engine and the DPF as vibration in the pitch direction (the direction of arrows b in FIG. 1). At this time, the DPF is disposed above the cylinder head and toward an end portion positioned away from the output shaft portion for the driven apparatus and thus, the DPF vibrates in the pitch direction more largely than the engine and the DPF supporting mechanism can be damaged.

In view of such circumstances, the present invention is mainly aimed at providing an engine that can suppress damage on a DPF supporting mechanism due to vibration in the pitch direction through reasonable modification utilizing the disposition structure on the intake side of a cylinder head.

Solution to Problem

In a first distinctive aspect of the present invention, an engine includes: a cylinder head; a diesel particulate filter (DPF) that purifies exhaust gas from an exhaust manifold, the DPF being disposed above the cylinder head in an orientation orthogonal or approximately orthogonal to a rotational axis of a crankshaft in a plan view; an intake manifold; and an intake collector that returns part of the exhaust gas to the intake manifold as exhaust gas recirculation (EGR) gas, the intake collector being fixed to the intake manifold.

In the engine, a support mechanism that enables the cylinder head, the intake manifold, and the intake collector to support the DPF is provided. The support mechanism includes a first support position in which the cylinder head supports the DPF, a second support position in which the intake manifold supports the DPF, and a third support position in which the intake collector supports the DPF, and the third support position deviates from the first support position and the second support position in a direction of the rotational axis of the crankshaft.

In the above-described configuration, the intake collector of an EGR device is fixed to the intake manifold to reduce the emission amount of nitrogen oxide by returning part of exhaust gas as EGR gas to the intake manifold. Accordingly, the intake collector belongs to a vibration system identical to that to which the cylinder head and the intake manifold belong. In addition, the third support position of the support mechanism in which the intake collector supports the DPF deviates further in the direction of the rotational axis of the crankshaft than the first support position of the support mechanism in which the cylinder head supports the DPF and the second support position of the support mechanism in which the intake manifold supports the DPF.

Utilizing the disposition structure of the intake collector identical in vibration system to the cylinder head and intake manifold described above, the support mechanism that enables the cylinder head and the intake manifold to support the DPF further enables the intake collector to support the DPF. Thus, the DPF can be supported at three points deviating in the direction of the rotational axis of the crankshaft, which are the first support position, the second support position, and the third support position. Accordingly, supporting strength against vibration in the pitch direction along the direction of the rotational axis of the crankshaft can be enhanced. In addition, compared to a case in which the DPF supporting mechanism is fixed between members different in vibration system, occurrence of internal stress in the support mechanism can be further suppressed, and the support mechanism can be made have a sturdier structure.

Thus, through the above-described reasonable modification utilizing the intake collector in the disposition structure on the intake side of the cylinder head, damage on the support mechanism of the DPF due to vibration in the pitch direction can be suppressed.

In a second distinctive aspect of the present invention, the support mechanism is made up of a first support unit for enabling the cylinder head and the intake manifold to support the DPF, and a second support unit for enabling the intake collector to support the DPF.

With the above-described configuration, even in an already-existing engine in which only the first support unit for enabling the cylinder head and the intake manifold to support the DPF is provided, damage on the support mechanism of the DPF due to vibration in the pitch direction can be suppressed simply by adding the second support unit for enabling the intake collector to support the DPF. As a result, modification cost for the already-existing engine including the first support unit only can be reduced.

In addition, compared to a case in which the cylinder head or the intake manifold supports the second support unit, the rigidities of the cylinder head and the intake manifold can be secured more desirably through the sharing of the load with the intake collector.

In a third distinctive aspect of the present invention, the first support unit includes a first bracket for enabling the cylinder head and the intake manifold to support a portion of the DPF positioned toward the intake manifold, and the second support unit is constituted by a second bracket provided on and between the first bracket and the intake collector.

In the above-described configuration, the first bracket of the first support unit is provided among three parts, which are a portion of the DPF toward the intake manifold, the cylinder head, and the intake manifold. Thus, the distance between the positions in which the first bracket and the intake collector are provided is shorter than the distance between the DPF and the intake collector. In accordance with the decrease in the distance between the positions in which the first bracket and the intake collector are provided, the weight and cost of the second bracket that constitutes the second support unit can be reduced In a fourth distinctive aspect of the present invention, the second support unit includes an abutting portion that is abuttable from above on an attachment portion provided on an upper surface of the intake collector, and the abutting portion is fastened to the attachment portion of the intake collector with a bolt oriented in an up-down direction.

In the above-described configuration, vibration in the pitch direction that acts on the DPF can be solidly received and supported by the abutting portion of the second support unit that abuts from the upper side, where the pitch direction occurs, on the attachment portion of the intake collector using bolts oriented in the up-down direction.

In a fifth distinctive aspect of the present invention, the DPF is disposed above the cylinder head and toward an end portion positioned away from an output shaft portion for a driven apparatus.

In the above-described configuration, as the DPF is positioned farther away from the output shaft portion for the driven apparatus, up-down vibration of the driven apparatus large in mass is amplified and acts as vibration in the pitch direction more largely. The amplified vibration in the pitch direction can be solidly received and supported at three points, which are the support positions among the cylinder head, the intake manifold, and the intake collector.

DESCRIPTION OF EMBODIMENTS

Embodiments of the present invention are described with reference to the drawings.

Figure 1:
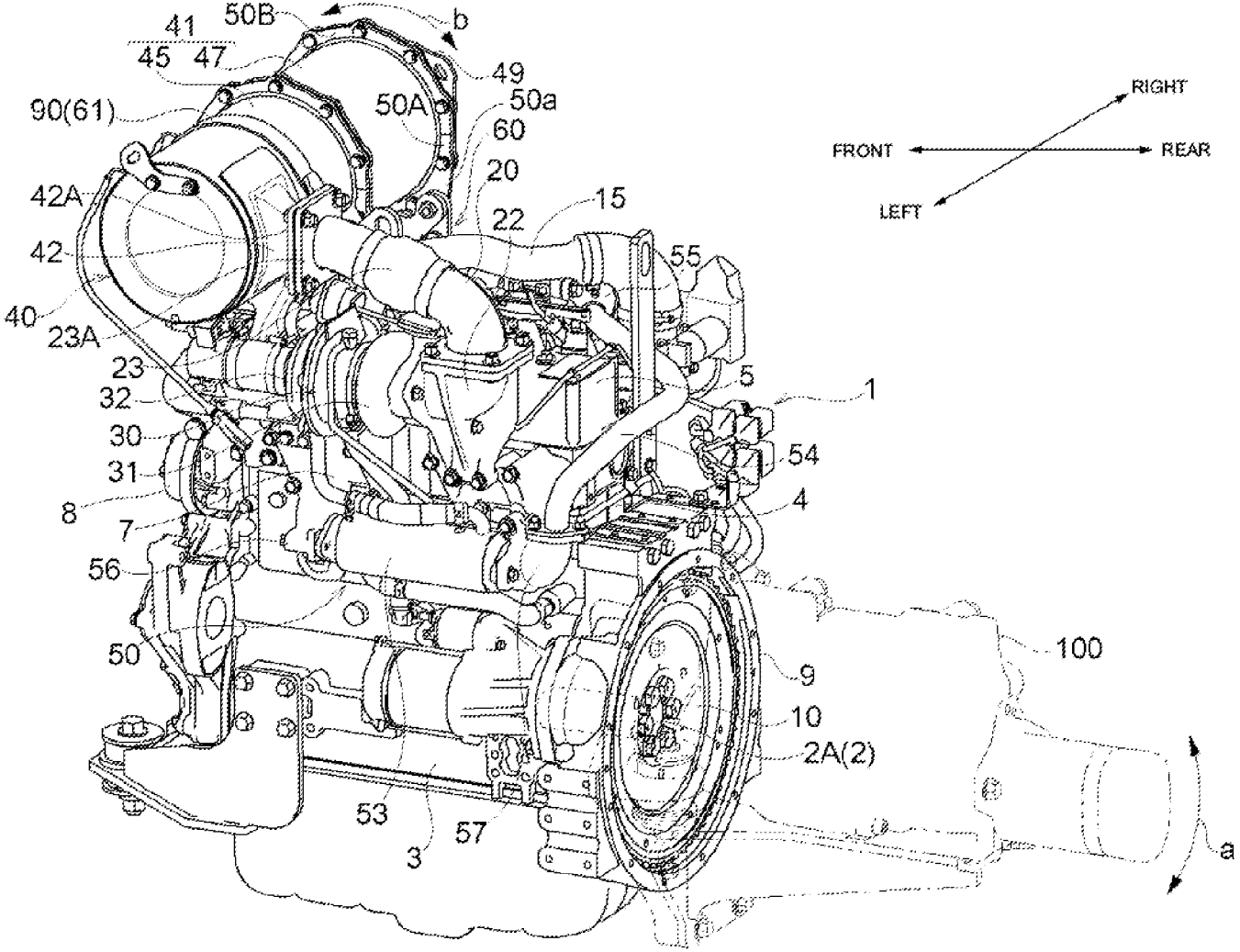
FIG. 1 A left perspective view of a diesel engine.
Figure 2:
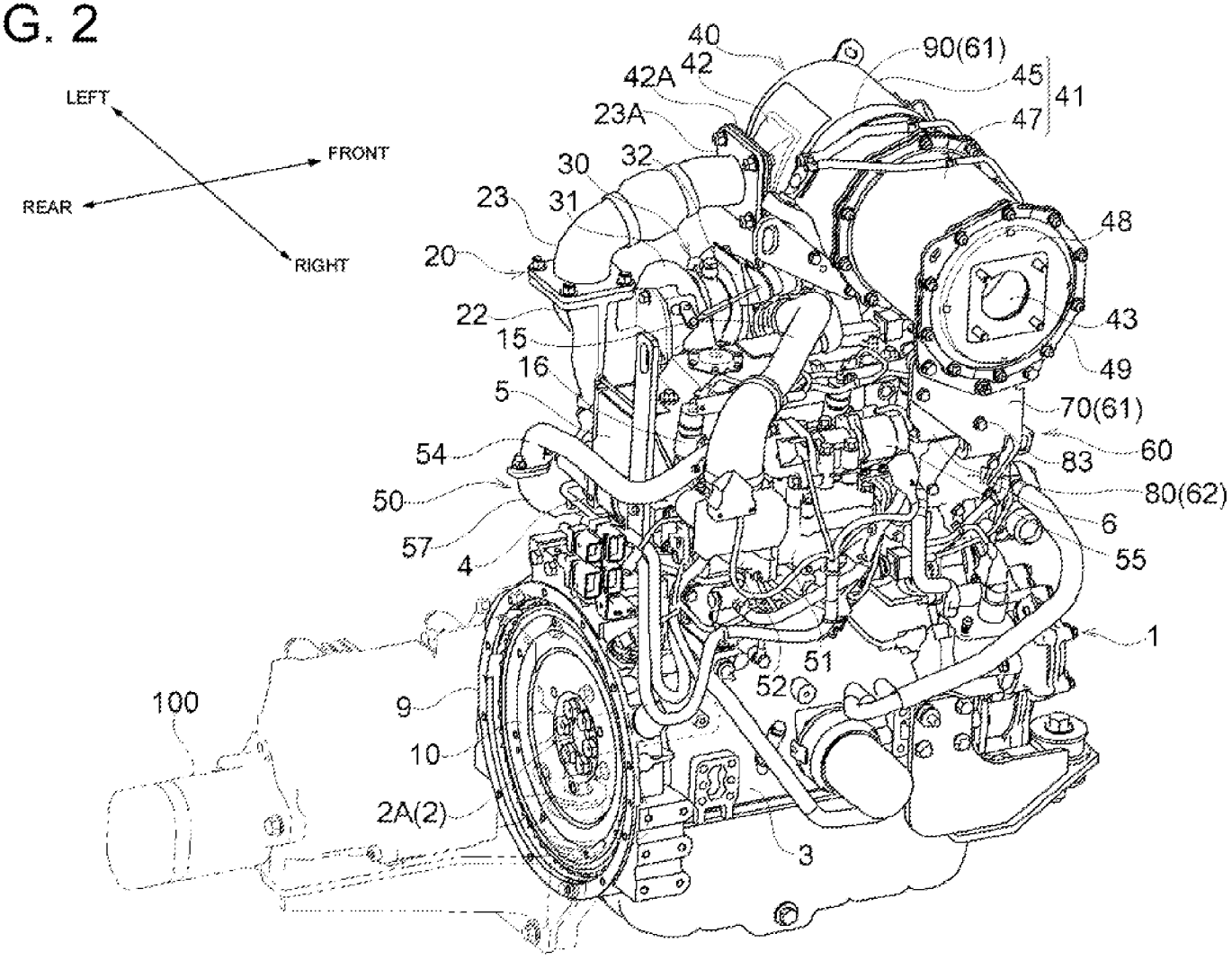
FIG. 2 A right perspective view of the diesel engine.

FIGS. 1 and 2 illustrate an example of an engine, which is a diesel engine 1 as a prime motor mounted on a work machine, such as a construction machine, an agricultural machine, or the like. In description of the diesel engine 1, it is assumed for convenience that an exhaust manifold 7 is disposed on the left side of the diesel engine 1 and an intake manifold 6 is disposed on the right side of the diesel engine 1. It is also assumed that the rotational axis of a crankshaft (an engine output shaft) 2 runs in the front-rear direction and a cooling fan (not illustrated) is disposed on the front side while an output shaft portion 2A of the crankshaft 2 is positioned on the rear side toward a driven apparatus 100.

FIGS. 1 and 2 are perspective views that illustrate the diesel engine 1 overall. To display the support structure of a DPF 40 clearly, FIGS. 3 to 8 depict the states where its peripheral components are removed as necessary. For example, FIG. 6 depicts the state where a turbocharger 30 is removed.

As illustrated in FIGS. 1 and 2, the diesel engine 1 includes a cylinder block 3 in which the crankshaft 2 for the output of the engine and a piston (not illustrated) are disposed. A cylinder head 4 is fixed to the upper surface of the cylinder block 3 and a head cover 5 is fixed to the upper surface of the cylinder head 4. The intake manifold 6 is fixed to a right side surface 4*c* of the cylinder head 4 (see FIG. 7) and the exhaust manifold 7 is fixed to a left side surface 4*b* of the cylinder head 4 (see FIG. 7). A fan shaft 8 that pivotally supports the cooling fan (not illustrated) is provided on the front surface of the cylinder block 3. A flywheel housing 9 is fixed to the rear surface of the cylinder block 3. In the flywheel housing 9, a flywheel 10 that is pivotally supported by an output shaft portion 2A positioned on the rear end side of the crankshaft 2 is disposed.

In the present embodiment, the driven apparatus 100, which is large in mass, is fixed and coupled to the flywheel housing 9 as indicated with the imaginary lines in FIGS. 1 and 2. An example of the driven apparatus 100 is a hydraulic pump for a work machine that is directly coupled to the output shaft portion 2A of the crankshaft 2.

An intake system of the diesel engine 1 includes an intake pipe 15, where a compressor 32 of the turbocharger 30 described later is provided, an intake collector 51 of an EGR device 50 described later, and the intake manifold 6.

As illustrated in FIG. 1, the turbocharger 30 is made up of a turbine 31 of the turbocharger 30, which is provided in an exhaust pipe 20, and the compressor 32, which is provided in the intake pipe 15. The turbine 31 is rotated by the energy of the exhaust gas that flows through the exhaust pipe 20 and drives the compressor 32 that is coaxial with the turbine 31. The compressor 32 compresses fresh air (outside air) sucked through an air cleaner (not illustrated). The "fresh air" denotes the air that does not contain EGR gas described later. The compressed and pressurized air with the pressure that exceeds the atmospheric pressure is delivered to the intake collector 51.

As illustrated in FIG. 6, an exhaust gas discharging tubular portion 21, which is opened upward to the outside, is formed to be integral with the exhaust manifold 7. As illustrated in FIG. 1, a gas inlet portion of the turbine 31 is connected to the exhaust gas discharging tubular portion 21 and an upstream end portion of an elbow-like pipe joint 22 is connected to a gas outlet portion of the turbine 31. An upstream end portion of an exhaust coupling pipe 23 connected to an exhaust gas introducing portion 42 of the DPF 40 is connected to a downstream end portion of the elbow-like pipe joint 22. As illustrated in FIGS. 1 and 2, a coupling flange 23A positioned on the downstream side of the exhaust coupling pipe 23 is fastened to a coupling flange 42A of the exhaust gas introducing portion 42 of the DPF 40 with bolts. The pipe joint 22 and the exhaust coupling pipe 23 described above make up the exhaust pipe 20.

As illustrated in FIG. 2, the intake manifold 6 divides the pressurized air supplied through the intake pipe 15 into parts, the number of which corresponds to the number of cylinders, and supplies the pressurized air parts to the cylinder head 4. An injector (a fuel injection device) 16 is disposed at the cylinder head 4. The injector 16 injects fuel into combustion chambers at predetermined timings. As a result of the injector 16 injecting the fuel to drive the pistons in the cylinder block 3, the diesel engine 1 can generate power.

As illustrated in FIG. 1, an exhaust system of the diesel engine 1 includes the exhaust manifold 7, the exhaust pipe 20 where the turbine 31 of the turbocharger 30 is provided, and the DPF 40 that constitutes a continuous regeneration type exhaust gas purifier.

The exhaust manifold 7 supplies the exhaust gas generated in the plurality of combustion chambers to the turbine 31 of the turbocharger 30 collectively. Part of the exhaust gas that has passed through the exhaust manifold 7 is returned by the EGR device 50 to the intake system as EGR gas and the remainder is purified through the DPF 40 and then discharged.

As illustrated in FIGS. 1 and 2, the EGR device 50 includes the intake collector 51, an intake throttle member 52, a recirculation exhaust gas pipe 54, and an EGR valve member 55. The intake collector 51 mixes part of the EGR gas from the exhaust manifold 7 with the fresh air supplied from the intake pipe 15 and supplies the resultant mixture to the intake manifold 6.

The intake throttle member 52 allows the intake pipe 15 and the intake collector 51 to communicate. The recirculation exhaust gas pipe 54 as a returning pipeline is connected to the exhaust manifold 7 with interposition of an EGR cooler 53. The EGR valve member 55 allows the recirculation exhaust gas pipe 54 and the intake collector 51 to communicate. The amount of the EGR gas supplied to the intake collector 51 is adjusted by adjusting the degree of opening of an EGR valve (not illustrated) in the EGR valve member 55.

With the above-described configuration, fresh air (outside air) is supplied from the intake pipe 15 into the intake collector 51 through the intake throttle member 52 while EGR gas is supplied from the exhaust manifold 7 into the intake collector 51 through the EGR valve member 55. The fresh air from the intake pipe 15 and the EGR gas from the exhaust manifold 7 are mixed in the intake collector 51 and then the resultant mixture is supplied to the intake manifold 6. That is, part of the exhaust gas discharged from the diesel engine 1 to the exhaust manifold 7 is returned from the intake manifold 6 to the diesel engine 1 and accordingly, the maximum combustion temperature at the time of high-load operation is lowered and the amount of nitrogen oxide (NOx) emitted from the diesel engine 1 is reduced.

A gas inlet portion of the EGR cooler 53 is connected to an EGR gas extracting pipe 56 formed to be integral with the exhaust manifold 7. A gas outlet portion of the EGR cooler 53 is connected to the recirculation exhaust gas pipe 54 with interposition of a pipe joint member 57. The pipe joint member 57 is fastened to the exhaust manifold 7 with bolts.

The DPF 40 includes a cylindrical exhaust gas purification case 41 that extends in the left-right direction and is made of a material of refractory metal. The exhaust gas introducing portion 42 that includes an exhaust gas introducing inlet 42*a* (see FIG. 3) opened rearward is formed to project on the left end portion side of the outer circumferential surface of the exhaust gas purification case 41. A purified gas discharging outlet 43 from which the purified exhaust gas is discharged is provided on an end surface of the exhaust gas purification case 41 on the right side. The exhaust gas discharged from the purified gas discharging outlet 43 is emitted to the outside through a silencer or a tail pipe.

Figure 3:
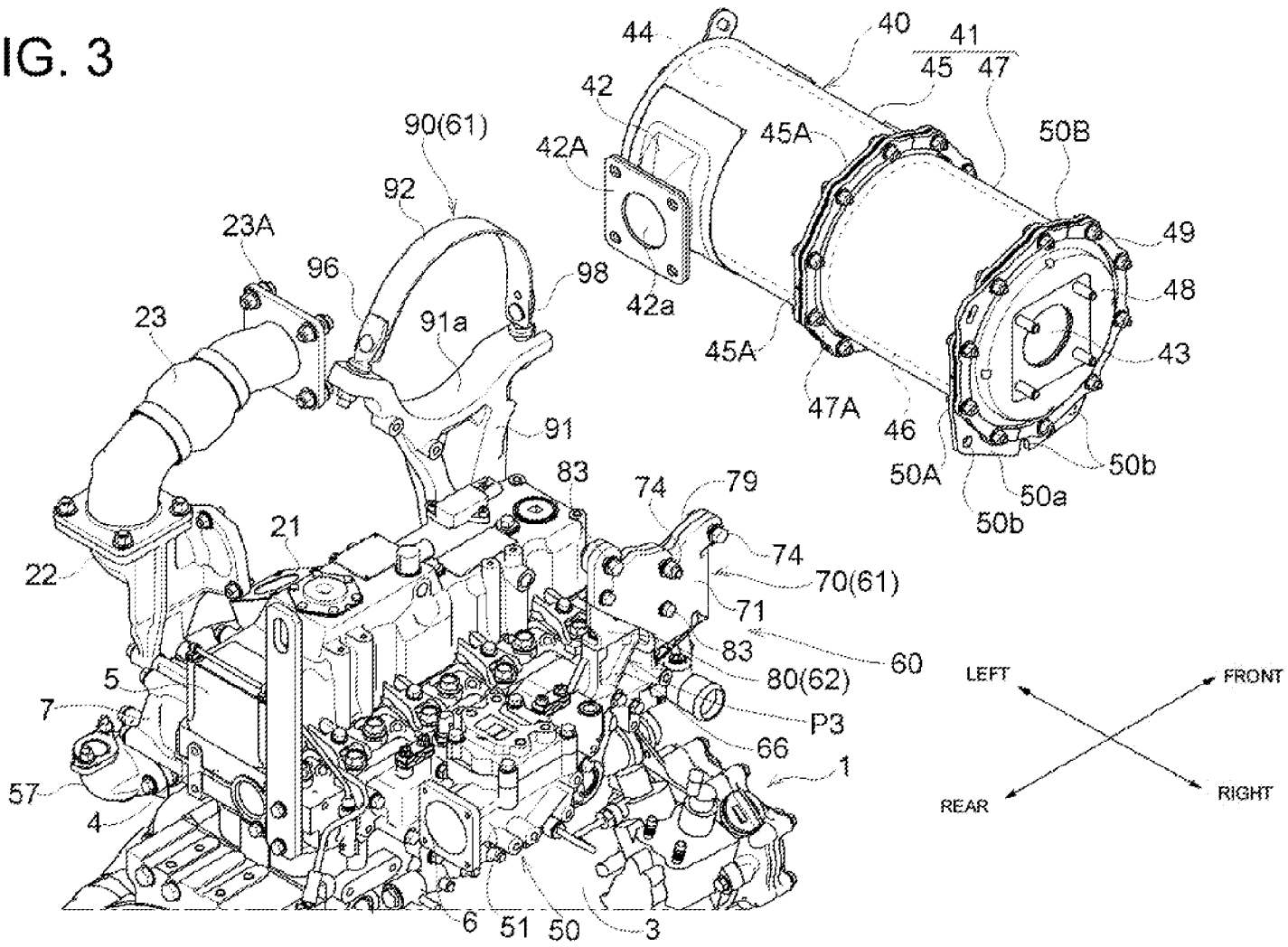
FIG. 3 A perspective view of an upper portion of the engine from which a DPF is separated.

As illustrated in FIG. 3, the exhaust gas purification case 41 includes a catalyst case body 45 and a filter case body 47. Inside the catalyst case body 45, a diesel oxidation catalyst 44 (a gas purifying body), such as platinum or the like, for producing nitrogen dioxide (NO2) is attached. Inside the filter case body 47, a soot filter 46 (a gas purifying body) having a honeycomb structure is attached to continuously oxidize and remove trapped particulate matters (PM) at a relatively low temperature. A first coupling flange 45A provided in a gas outlet-side end portion of the catalyst case body 45 and a second coupling flange 47A provided in a gas inlet-side end portion of the filter case body 47 are fastened with bolts and nuts in a state of being joined in the left-right direction.

As illustrated in FIGS. 2 and 3, a lid body 48, which includes the purified gas discharging outlet 43, and a third coupling flange 49 are provided in a gas outlet-side end portion of the filter case body 47. Split reinforcing flange plates 50A and 50B (see FIG. 1), which are split into two parts in the circumferential direction, are fastened with bolts and nuts on the side of the back surface of the third coupling flange 49. A coupling plate portion 50*a*, which projects further outward in the diameter direction than the third coupling flange 49, is formed to be integral with the lower split reinforcing flange plate 50A. A plurality of bolt insertion holes 50*b* for fastening a first bracket 70 described later with first bolts 74 and nuts 75 in the left-right direction are formed in the coupling plate portion 50*a*.

In the present embodiment, as illustrated in FIG. 3, the bolt insertion holes 50*b* are formed in three locations in the circumferential direction on the lower side of the split reinforcing flange plate 50A toward the exhaust gas purification case 41. The bolt insertion holes 50*b* positioned on both sides in the circumferential direction are formed as circular holes. The bolt insertion hole 50*b* positioned centrally in the circumferential direction is formed as an approximately "U"-shaped cut hole opened downward.

With the above-described configuration, the NO2 produced by the oxidation effect of the diesel oxidation catalyst 44 is supplied into the soot filter 46. The PMs contained in the exhaust gas of the diesel engine 1 are trapped at the soot filter 46 and continuously oxidized and removed by the NO2. In addition to the removal of the PMs in the exhaust gas of the diesel engine 1, the amounts of carbon monoxide (CO) and hydrocarbon (HC) contained in the exhaust gas of the diesel engine 1 are also reduced.

In the diesel engine 1 configured as described above, particularly in the diesel engine 1 mounted on a work machine, such as a skid steer loader or the like, the driven apparatus 100, such as a hydraulic pump or the like, which is large in mass and is used for the work machine directly coupled to the output shaft portion 2A of the crankshaft 2, is fixed and coupled to the flywheel housing 9 as indicated with the imaginary lines in FIGS. 1 and 2. Accordingly, when the work machine travels over an uneven surface of the ground or steps for example, up-down vibration of the work machine (in the direction of the arrows a in FIG. 1) is amplified by the driven apparatus 100 large in mass and propagates to the diesel engine 1 and the DPF 40 as vibration in the pitch direction (the direction of the arrows b in FIG. 1). At this time, the DPF 40 is disposed above the cylinder head 4 and toward a front end portion positioned forward away from the output shaft portion 2A of the crankshaft 2. Consequently, a phenomenon occurs, in which the DPF 40 vibrates in the pitch direction more largely than the diesel engine 1.

In view of the above, the support structure of the DPF 40 according to the present invention addresses such vibration in the pitch direction through reasonable modification utilizing the disposition structure on the intake side of the cylinder head 4. The following describes its specific structure in detail.

As illustrated in FIGS. 3 to 8, a support mechanism 60 is provided, which enables the exhaust gas purification case 41 of the DPF 40 to be supported by the cylinder head 4 and the intake manifold 6 and supported by the intake collector 51, which deviates from the support positions of the cylinder head 4 and the intake manifold 6 in the rotational axis direction of the crankshaft 2. The support mechanism 60 is made up of a first support unit 61 for enabling the cylinder head 4 and the intake manifold 6 to support the exhaust gas purification case 41 and a second support unit 62 for enabling the intake collector 51 to support the exhaust gas purification case 41.

Further, the first support unit 61 includes the first bracket 70 and a fixing band 90. The first bracket 70 is used to fix a portion of the exhaust gas purification case 41 positioned toward the intake manifold 6 to the cylinder head 4 and the intake manifold 6. The fixing band 90 is used to fix a portion of the exhaust gas purification case 41 positioned toward the exhaust manifold 7 to the cylinder head 4.

The second support unit 62 is constituted by a second bracket 80 provided on and between the first bracket 70 and the intake collector 51.

Figure 5:
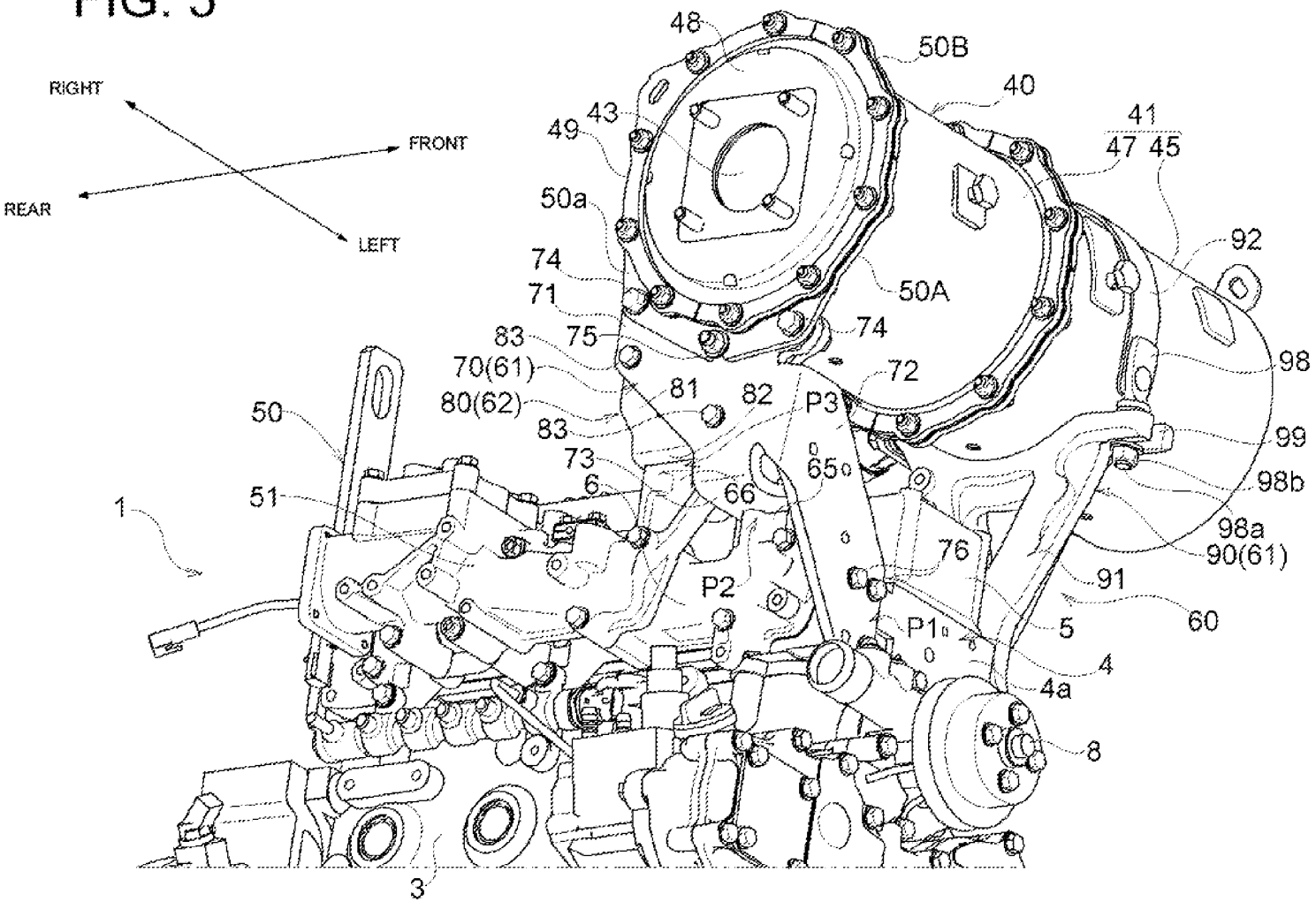
FIG. 5 A right perspective view of the attachment portion of the DPF.
Figure 6:
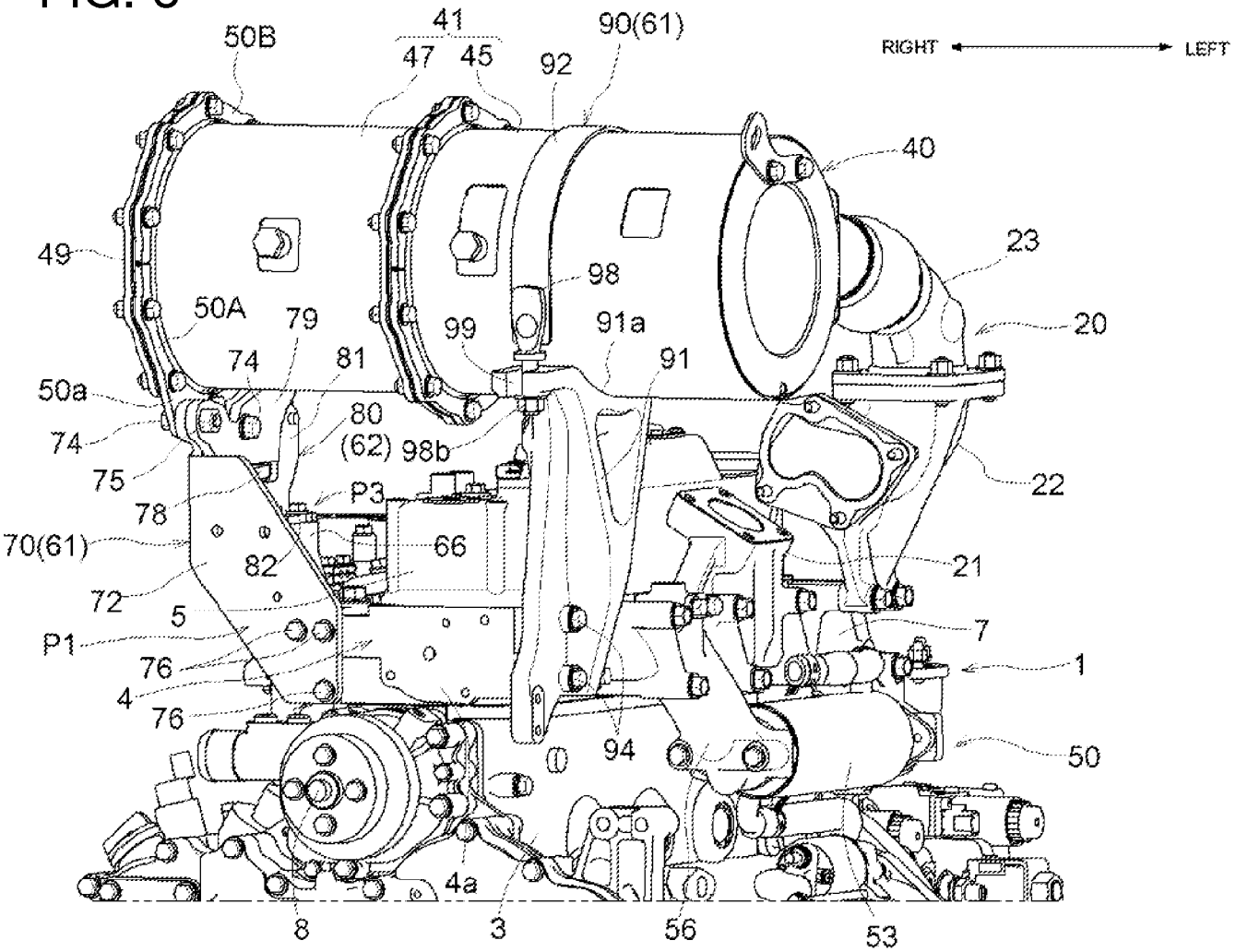
FIG. 6 A front perspective view of the attachment portion of the DPF.
Figure 7:
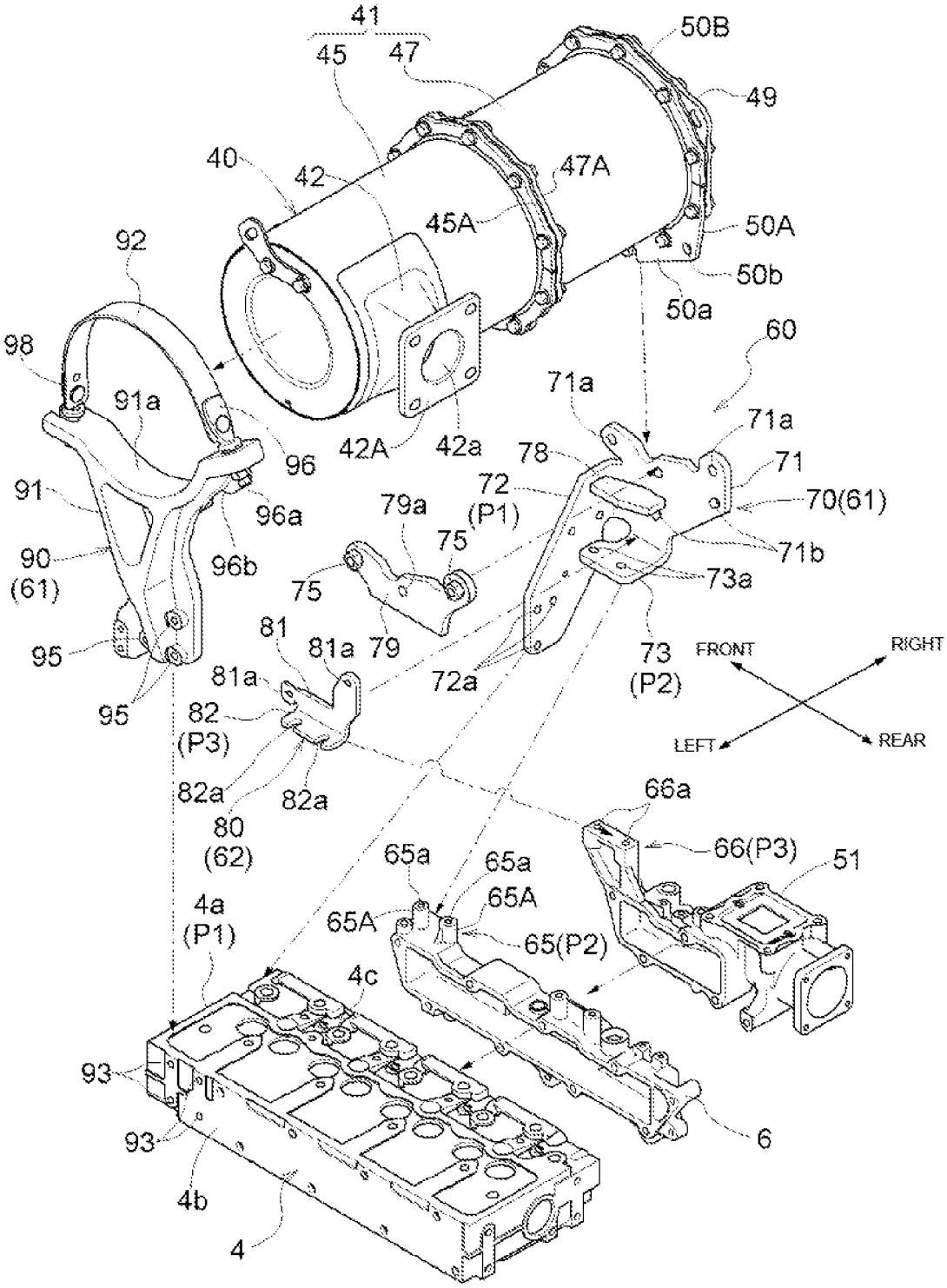
FIG. 7 An exploded perspective view of the attachment portion of the DPF.

As illustrated in FIGS. 5 to 7, the first bracket 70 includes a first attachment plate portion 71, a second attachment plate portion 72, and a third attachment plate portion 73. The first attachment plate portion 71 is abuttable on the back surface of the split reinforcing flange plate 50A of the exhaust gas purification case 41 and is in a vertical orientation along the front-rear direction. The second attachment plate portion 72 is abuttable on a front surface 4*a* of the cylinder head 4 and is in a vertical orientation along the left-right direction. The third attachment plate portion 73 is abuttable on a first attachment portion 65 provided in a front end portion of the intake manifold 6 on its upper surface and is in a horizontal orientation along the left-right direction.

The second attachment plate portion 72 is provided in a front end portion of the first attachment plate portion 71 and formed by being bent inward in the left-right direction at a right angle and extends obliquely downward toward a left side portion of the front surface 4*a* of the cylinder head 4. The third attachment plate portion 73 is provided in a lower end portion of the first attachment plate portion 71 and formed to be along the horizontal direction by being bent inward in the left-right direction at a right angle.

As illustrated in FIGS. 5 to 7, a plurality of first bolt insertion holes 71*a* are formed in an upper end portion of the first attachment plate portion 71 of the first bracket 70. The first bolt insertion holes 71*a* are used to fasten the coupling plate portion 50*a* of the split reinforcing flange plate 50A of the exhaust gas purification case 41 with the first bolts 74 and nuts 75 oriented in the left-right direction.

In the present embodiment, the first bolt insertion holes 71*a* of the first attachment plate portion 71 are formed in portions corresponding to three locations in the circumferential direction of the split reinforcing flange plate 50A of the exhaust gas purification case 41. The first bolt 74 is inserted into the first bolt insertion hole 71*a* positioned centrally in the circumferential direction from the inside. The nut 75 corresponding to the central first bolt 74 is screwed from the outside. This insertion direction is opposite to the direction in which the other first bolts 74 are inserted into the first bolt insertion holes 71*a* on both sides in the circumferential direction. The bolt insertion hole 50*b*, which is approximately "U"-shaped and centrally positioned in the circumferential direction of the lower split reinforcing flange plate 50A, is engaged with and held on the first bolt 74 centrally positioned in the circumferential direction from above, in a state in which the exhaust gas purification case 41 of the DPF 40 is placed on an accepting surface 91*a* of a support base 91 of the fixing band 90. Thus, the load of the DPF 40 can be received and supported by the first bracket 70 and the support base 91 of the fixing band 90, and the fixing operation of the DPF 40 can be facilitated accordingly.

As illustrated in FIGS. 5 to 7, a plurality of second bolt insertion holes 72*a* are formed in a lower end portion of the second attachment plate portion 72. The second bolt insertion holes 72*a* are used for fastening into a plurality of screw holes (not illustrated) formed in a right side portion of the front surface 4*a* of the cylinder head 4 with second bolts 76 oriented in the front-rear direction.

In the present embodiment, the second bolt insertion holes 72*a* of the second attachment plate portion 72 are formed in three positions corresponding to the vertices of a triangle.

Figure 4:
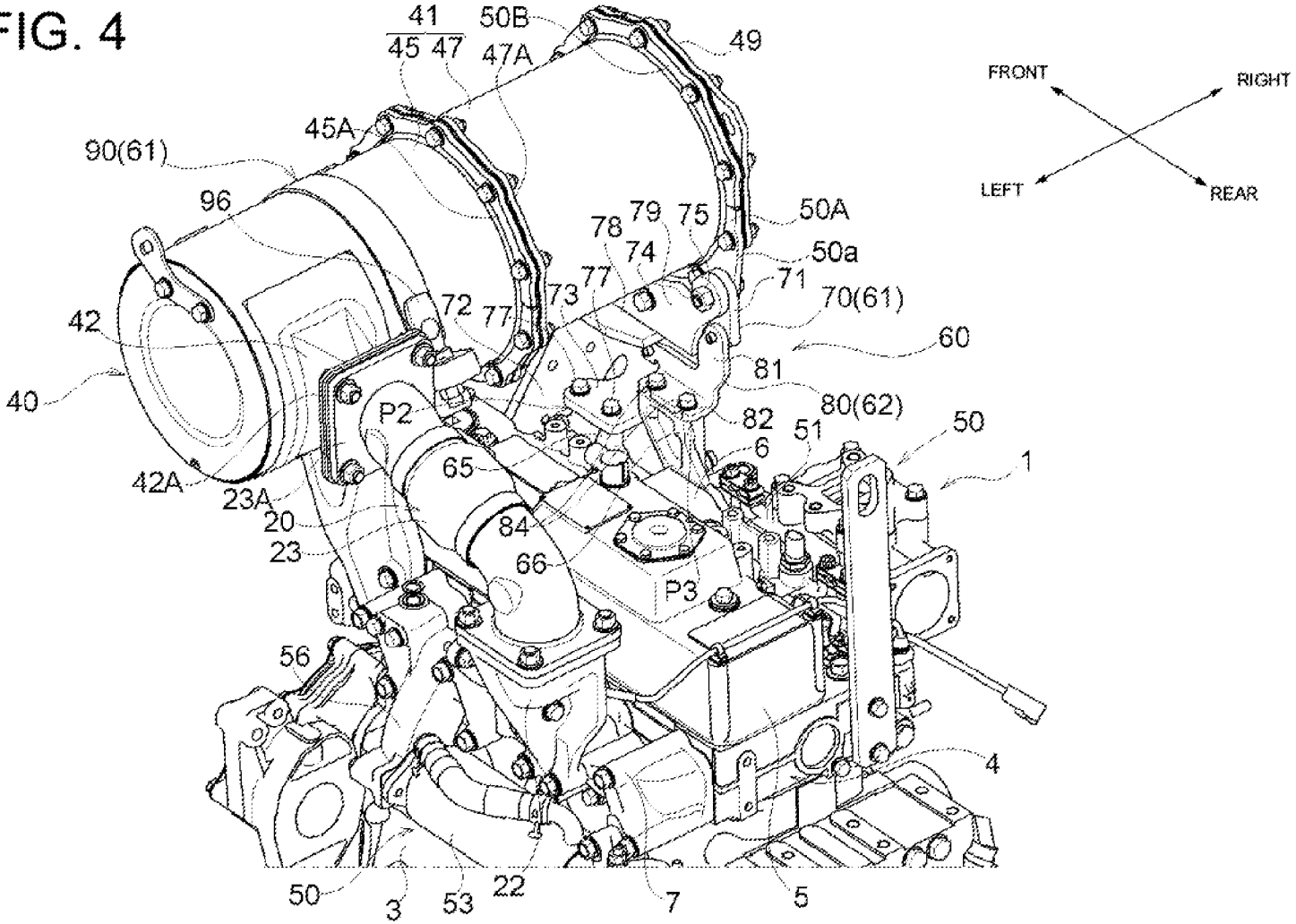
FIG. 4 A left perspective view of an attachment portion of the DPF.
Figure 8:
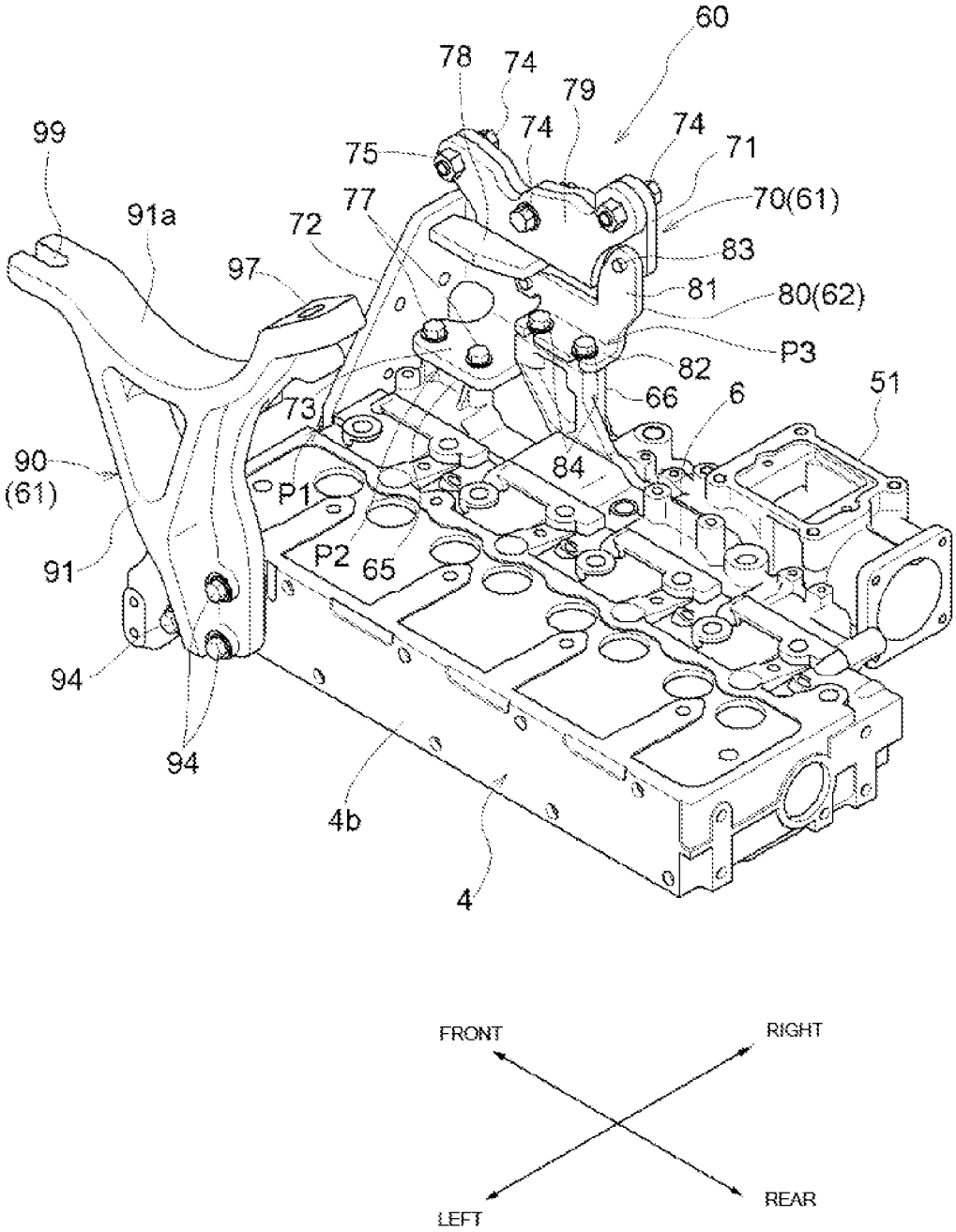
FIG. 8 An assembly perspective view of the attachment portion of the DPF.

As illustrated in FIGS. 4, 7, and 8, a plurality of third bolt insertion holes 73*a* are formed in a distal end portion of the third attachment plate portion 73. The third bolt insertion holes 73*a* are used for fastening into a plurality of first screw holes 65*a* formed in the first attachment portion 65 of the intake manifold 6 with third bolts 77 oriented in the up-down direction.

In the present embodiment, the third bolt insertion holes 73*a* of the third attachment plate portion 73 are formed in two positions at predetermined spacing in the front-rear direction.

As illustrated in FIG. 7, the first attachment portion 65 of the intake manifold 6 is formed into a shape in which two columnar bodies 65A are integrally joined in the front-rear direction. The first screw hole 65*a* opened upward is formed in the horizontal upper surface of each columnar body 65A.

Further, as illustrated in FIGS. 7 and 8, a horizontal reinforcing plate 78 is secured between the inner surface of the first attachment plate portion 71 of the first bracket 70 and the inner surface of the second attachment plate portion 72 of the first bracket 70 by welding or the like. A load transmission plate 79, which abuts on the upper surface of the reinforcing plate 78 from above, is tightly fixed to the inner surface of the first attachment plate portion 71 of the first bracket 70 using the first bolts 74 and nuts 75 together with the split reinforcing flange plate 50A of the exhaust gas purification case 41. Accordingly, a fourth bolt insertion hole 79*a* is formed in each of three positions along the circumferential direction of the split reinforcing flange plate 50A in the load transmission plate 79 to penetrate in the left-right direction. As illustrated in FIG. 7, the nuts 75 are secured to the inner surface of the load transmission plate 79 by welding or the like in portions corresponding to the fourth bolt insertion holes 79*a* on both sides in the circumferential direction.

With the above-described configuration, part of the load of the DPF 40 can also be supported in an abutting portion between the reinforcing plate 78 of the first bracket 70 and the load transmission plate 79. Thus, compared to a case in which the first attachment plate portion 71 of the first bracket 70 and the split reinforcing flange plate 50A positioned toward the exhaust gas purification case 41 are fastened only with the first bolts 74 and nuts 75, the support mechanism 60 of the DPF 40 can be made have a sturdier structure.

As illustrated in FIGS. 4, 7, and 8, the second bracket 80 includes a vertical plate portion 81 and a horizontal plate portion 82 (as an example of the abutting portion). The vertical plate portion 81 extends in the front-rear direction and is abuttable on a portion that is included in the inner surface of the first attachment plate portion 71 of the first bracket 70 and does not include the attachment region to which the reinforcing plate 78 and the load transmission plate 79 are attached. The horizontal plate portion (an example of the abutting portion) 82 extends in the front-rear direction and is abuttable from above on the horizontal upper surface of a second attachment portion 66 formed to project from the upper surface of a front end portion of the intake collector 51.

The vertical plate portion 81 is formed to have an outline that is approximately "L"-shaped when viewed in the left-right direction. The horizontal plate portion 82 is formed at the lower end of the vertical plate portion 81 by being bent inward in the left-right direction at a right angle.

As illustrated in FIG. 7, a third screw hole 81*a* is formed in each of an upper end portion and a front end portion of the vertical plate portion 81 of the second bracket 80 to penetrate in the left-right direction. Fifth bolt insertion holes 71*b* are formed in the first attachment plate portion 71 of the first bracket 70 to penetrate in the left-right direction and correspond to the third screw holes 81*a* of the vertical plate portion 81.

As illustrated in FIGS. 3 to 5 and 7, the vertical plate portion 81 of the second bracket 80 and the first attachment plate portion 71 of the first bracket 70 are fastened by threading the fourth bolts 83, which have been inserted into the fifth bolt insertion holes 71*b* and are oriented in the left-right direction, into the third screw holes 81*a* so that the fourth bolts 83 are screwed therein.

As illustrated in FIG. 7, sixth bolt insertion holes 82*a* are formed in the horizontal plate portion 82 of the second bracket 80 to penetrate in the up-down direction. Second screw holes 66*a* are formed in the second attachment portion 66 of the intake collector 51 to be opened upward.

In the present embodiment, the sixth bolt insertion holes 82*a* of the horizontal plate portion 82 and the second screw holes 66*a* of the second attachment portion 66 are each formed in two positions in the front-rear direction. The sixth bolt insertion holes 82*a* of the horizontal plate portion 82 are formed by being cut into the shape of approximate "U" in a plan view to be opened toward the intake manifold 6.

The horizontal plate portion 82 of the second bracket 80 and the second attachment portion 66 of the intake collector 51 are fastened by threading fifth bolts 84, which have been inserted into the sixth bolt insertion holes 82*a* of the horizontal plate portion 82 and are oriented in the up-down direction, into the second screw holes 66*a* of the second attachment portion 66 so that the fifth bolts 84 are screwed therein.

As illustrated in FIGS. 3, 5 to 8, the fixing band 90 includes the support base 91 and a band member 92. The support base 91 includes the accepting surface 91*a*, which is arc-shaped and can accept a portion of the exhaust gas purification case 41 positioned toward the exhaust manifold 7, and is approximately "Y"-shaped when viewed in the left-right direction. The band member 92 is flexible and draws the exhaust gas purification case 41 placed on the support base 91 toward the accepting surface 91*a* to tighten and fix the exhaust gas purification case 41.

As illustrated in FIG. 7, a plurality of seventh bolt insertion holes 95 are formed in a lower end portion of the support base 91. The seventh bolt insertion holes 95 are used for fastening into a plurality of fourth screw holes 93 formed in a front end portion of the left side surface 4*b* of the cylinder head 4 with sixth bolts 94 oriented in the left-right direction.

As illustrated in FIGS. 5 to 8, a first screw insertion hole 97 is formed in a rear end portion of the accepting surface 91*a* of the support base 91 to penetrate therethrough. A screw shaft 96*a* of a first metal clamp 96 provided in an end portion of the band member 92 is inserted into the first screw insertion hole 97. The screw shaft 96*a* of the first metal clamp 96 inserted in the first screw insertion hole 97 is fixed while prevented from separation by having the nut 96*b* screwed on a distal end portion of the screw shaft 96*a* that projects downward from the first screw insertion hole 97 (see FIG. 8).

As illustrated in FIGS. 3, 7, and 8, in a front side end portion of the accepting surface 91*a* of the support base 91, a second screw insertion hole 99 (see FIG. 8) is formed by being cut to be approximately "U"-shaped in a plan view. A screw shaft 98*a* of a second metal clamp 98 provided in the other end portion of the band member 92 is attachable to and detachable from the second screw insertion hole 99 from the front side. A nut 98*b* is screwed on a distal end portion of the screw shaft 98*a* of the second metal clamp 98 inserted in the second screw insertion hole 99, and the nut 98*b* is tightened to the restraint side. Owing to the diameter reduction variation of the band member 92 that the tightening operation for the nut 98*b* accompanies, the exhaust gas purification case 41 placed on the support base 91 is drawn toward the accepting surface 91*a* to be tightened and fixed.

In the support structure of the DPF 40 configured as described above, as illustrated in FIGS. 7 and 8, the intake manifold 6 is firmly fixed to the right side surface 4*c* of the cylinder head 4 with the plurality of bolts. Further, the intake collector 51 is firmly fixed to the outer surface of the intake manifold 6 with the plurality of bolts. Accordingly, the cylinder head 4, the intake manifold 6, and the intake collector 51 belong to an identical vibration system.

As illustrated in FIGS. 7 and 8, the intake manifold 6 has a length that reaches the vicinity of the rear end of the right side surface 4*c* of the cylinder head 4 from the vicinity of the front end thereof. The intake collector 51 has a length that reaches the vicinity of the rear end of the intake manifold 6 from a position deviating slightly rearward from the front end of the intake manifold 6. Accordingly, as illustrated in FIGS. 4 and 8, the first attachment portion 65 formed in a front end portion of the intake manifold 6 on its upper surface is positioned slightly further rearward than the front surface 4*a* of the cylinder head 4. The second attachment portion 66 formed to project from the upper surface of the front end portion of the intake collector 51 is disposed to deviate slightly further rearward than the first attachment portion 65 of the intake manifold 6.

As illustrated in FIGS. 5 and 6, the second attachment plate portion 72 of the first bracket 70 that constitutes part of the first support unit 61 of the support mechanism 60 is firmly fixed to the front surface 4*a* of the cylinder head 4 with the plurality of second bolts 76 oriented in the front-rear direction. The fixing and coupling position of the second attachment plate portion 72 of the first bracket 70 and the front surface 4*a* of the cylinder head 4 is denoted as the first support position P1, in which the cylinder head 4 supports the DPF 40. As illustrated in FIGS. 4, 5, and 8, the third attachment plate portion 73 of the first bracket 70 abuts from above on the first attachment portion 65 of the intake manifold 6, which slightly deviates further rearward than the front surface 4*a* of the cylinder head 4. The abutting third attachment plate portion 73 is firmly fixed to the first attachment portion 65 of the intake manifold 6 with the plurality of third bolts 77 oriented in the up-down direction. The fixing and coupling position of the first attachment portion 65 of the intake manifold 6 and the third attachment plate portion 73 of the first bracket 70 is denoted as the second support position P2, in which the intake manifold 6 supports the DPF 40.

Further, as illustrated in FIGS. 4, 5, and 8, the vertical plate portion 81 of the second bracket 80 of the second support unit 62 is firmly fixed to the first attachment plate portion 71 of the first bracket 70 with the plurality of fourth bolts 83 oriented in the left-right direction. The horizontal plate portion 82 of the second bracket 80 abuts from above on the second attachment portion 66 of the intake collector 51, which deviates further rearward than the first attachment portion 65 of the intake manifold 6. The abutting horizontal plate portion 82 is firmly fixed to the second attachment portion 66 of the intake collector 51 with the plurality of fifth bolts 84 oriented in the up-down direction. The fixing and coupling position of the horizontal plate portion 82 of the second bracket 80 and the second attachment portion 66 of the intake collector 51 is denoted as the third support position P3, in which the intake collector 51 supports the DPF 40.

The split reinforcing flange plate 50A of the exhaust gas purification case 41 of the DPF 40 is firmly coupled to the first attachment plate portion 71 of the first bracket 70 with the plurality of first bolts 74 and nuts 75. In the coupled state, a portion of the DPF 40 positioned toward the intake manifold 6 is supported at three points deviating in the front-rear direction, which are the first support position P1 toward the front surface 4*a* of the cylinder head 4, the second support position P2 toward the first attachment portion 65 of the intake manifold 6, and the third support position P3 toward the second attachment portion 66 of the intake collector 51. Accordingly, supporting strength against vibration in the pitch direction along the rotational axis direction of the crankshaft 2 can be enhanced. In addition, compared to a case in which the support mechanism 60 of the DPF 40 is fixed between members different in vibration system, occurrence of internal stress in the support mechanism 60 can be suppressed more desirably, and the support mechanism 60 can be made have a sturdier structure.

Accordingly, through the above-described reasonable modification utilizing the intake collector 51 in the intake side disposition structure of the cylinder head 4, damage on the support mechanism 60 of the DPF 40 due to vibration in the pitch direction can be suppressed.

The first bracket 70 of the first support unit 61 is provided among three parts, which are a portion of the DPF 40 positioned toward the intake manifold 6, that is, the split reinforcing flange plate 50A of the exhaust gas purification case 41, the front surface 4*a* of the cylinder head 4, and the first attachment portion 65 of the intake manifold 6. Thus, the distance between the positions in which the first bracket 70 and the second attachment portion 66 of the intake collector 51 are provided is shorter than the distance between the DPF 40 and the intake collector 51. In accordance with the decrease in the distance between the positions in which the first bracket 70 and the second attachment portion 66 of the intake collector 51 are provided, the weight and cost of the second bracket 80 that constitutes the second support unit 62 can be reduced.

Further, compared to a case in which the cylinder head 4 or the intake manifold 6 supports the second bracket 80 of the second support unit 62, the rigidities of the cylinder head 4 and the intake manifold 6 can be secured more desirably through the sharing of load with the intake collector 51.

Other Embodiments (1) Although the above-described embodiment discusses the diesel engine 1 in which the DPF 40 is disposed above the cylinder head 4 and toward an end portion positioned away from the output shaft portion 2A for the driven apparatus 100, the techniques of the present invention are also applicable to the diesel engine 1 in which the DPF 40 is disposed above the cylinder head 4 and toward an end portion positioned close to the output shaft portion 2A.

(2) Although the first bracket 70 of the first support unit 61 and the second bracket 80 of the second support unit 62 are structured as being separate in the above-described embodiment, the first bracket 70 and the second bracket 80 may be structured to be integral by bending, welding, or the like.

(3) Although the second bracket 80 of the second support unit 62 is provided between the first bracket 70 and the second attachment portion 66 of the intake collector 51 in the above-described embodiment, the second bracket 80 may be provided on and between the DPF 40 and the second attachment portion 66 of the intake collector 51.

INDUSTRIAL APPLICABILITY

The present invention is suitably applicable to various engines.

REFERENCE SIGNS LIST

2 crankshaft
2A output shaft portion
4 cylinder head
6 intake manifold
7 exhaust manifold
40 DPF
51 intake collector
60 support mechanism
61 first support unit
62 second support unit
66 attachment portion (second attachment portion)
70 first bracket
80 second bracket
82 abutting portion (horizontal plate portion)
84 bolt (fifth bolt)
100 driven apparatus
P1 first support position
P2 second support position
P3 third support position

The invention claimed is:

1. An Engine comprising:
a cylinder head;
an exhaust manifold;
a DPF that purifies exhaust gas from the exhaust manifold; and
a support mechanism for supporting the DPF at least on the cylinder head,
wherein the DPF extends in the left-right direction of the engine and is supported at least in the vertical direction and the front-rear direction of the engine.

2. The engine according to claim 1, wherein the DPF is further supported in the left-right direction of the engine.

3. The engine according to claim 1, wherein the support mechanism further supports the DPF on the intake manifold.

4. The engine according to claim 1, wherein a support base that supports a side of the exhaust manifold of the DPF is fixed to the cylinder head.

* * * * *